United States Patent [19]

Gilbert et al.

[11] Patent Number: 4,868,991

[45] Date of Patent: Sep. 26, 1989

[54] INVENTORY CONTROL BOARD

[76] Inventors: Michael D. Gilbert, 5845 Canyon View Dr.; Dennis V. Worthington, 2020 Picnic La.; Lonnie R. Marbley, 6181 Woodbrook Cir., all of Paradise, Calif. 95969

[21] Appl. No.: 187,749

[22] Filed: Apr. 29, 1988

[51] Int. Cl.[4] ..... B43L 5/00

[52] U.S. Cl. ..... 33/430; 281/45

[58] Field of Search ..... 33/430, 437, 443, 444, 33/445, 446, 483, 494; 283/900; 281/45, 1

[56] References Cited

U.S. PATENT DOCUMENTS

| | | | |
|---|---|---|---|
| 1,240,621 | 9/1917 | Story | 33/443 |
| 1,452,694 | 4/1923 | Lund | 33/443 |
| 1,483,176 | 2/1924 | Henrikson | 281/1 |
| 1,817,640 | 8/1931 | Newman et al. | 33/430 X |
| 1,863,633 | 6/1932 | Melind | 40/649 X |
| 2,670,221 | 2/1954 | Wellendorf | 281/45 X |
| 2,725,030 | 11/1955 | Hughesx | 281/45 X |
| 2,864,169 | 12/1958 | Klabunde | 33/430 |
| 4,545,140 | 10/1985 | Winston | 40/661 |

*Primary Examiner*—Harry N. Haroian

*Attorney, Agent, or Firm*—Richard C. Litman

[57] ABSTRACT

A control apparatus insures precise reading or entry of data in the proper columns and rows or lines of chart sheets mounted atop a board. The same columns with appropriate indicia appear on both the top of the chart sheets and on a vertically shiftable ruler member attached to the board. A slide block associated with the ruler member not only maintains the ruler in a positive horizontal disposition parallel to the chart sheet rows but automatically adjusts in height to accommodate a varied amount of chart sheets on the board.

9 Claims, 2 Drawing Sheets

INVENTORY CONTROL BOARD

BACKGROUND OF THE INVENTION

This invention relates generally, to a control board used in conjunction with a chart applicable particularly to record and display a plurality of activities associated with various items or instances, such as the administration of drugs or other medications. It is desirable to maintain a visual record of a plurality of parameters relating to numerous persons or items on a single chart sheet and to be able to quickly and precisely read or enter data at any vertical or horizontal point on the sheet particularly in the critical field of administration of pharmaceutical medicaments and it will be appreciated that convenient chart means will be applicable in other areas of administrative record keeping or inventory control.

Several devices have been suggested in the past for movable superimposed characters. U.S. Pat. No. 4,221,057 issued Sept. 9, 1980 to Luikart discloses a slide with different indexing means on a first and second slideable indexing or recording means. Another example will be found in U.S. Pat. No. 4,364,184 issued Dec. 21, 1982 to Dowzall and which discloses a sign making apparatus with a spring loaded captive ball detent means affixed to a carriage. In both these prior assemblies mobility of slide means is one dimensional.

SUMMARY OF THE INVENTION

By the present invention an improved control board includes a slideable ruler member manipulated in conjunction with a chart mounted upon the board and which is used to record the administration of drugs or other medications. The board essentially is rectangular in shape and includes registry means in the form of plugs at the top, serving to precisely orient and secure a plurality of chart sheets atop the board. A slide rod runs the length of the board on the left side and provides a mount for a block slidably mounted on the rod by means of an enlarged groove or channel through the block. A wrap around ruler blade attached to the block is covered with a clear shroud wrapped around the ruler blade. The ruler is secured to the block and extends the width of the control board. A heading strip having column headings identical to those contained on the top of each chart sheet is inserted under the clear shroud about the ruler. In this manner, the ruler can be moved vertically to any position on the chart to ensure that entries are made in the proper column and on the proper row or line of the uppermost, underlying chart sheet. The channel through the block enables the ruler to be raised or lowered to accommodate a chart pad of any thickness and insures that the ruler at all times automatically flushly engages the topmost chart sheet, regardless of the number of sheets mounted on the board.

Accordingly one of the objects of the present invention is to provide an improved control board with a shiftable ruler member vertically alignable to allow a user to selectively apply specific data in a proper columnar format on an underlying data sheet.

A further object of the present invention is to provide an improved control board having a shiftable ruler provided with a replaceable indicia heading strip that visibly duplicates the columnar data headings at the top of underlying chart sheets.

Another object of the present invention is to provide an improved control board including ruler means that traverses the entire width of the chart and juxtaposes columnar entry indicia in alignment with that corresponding to indicia on an underlying chart heading.

Still another object of the present invention is to provide an improved control board having a ruler member automatically raised or lowered as an underlying pad thickness varies.

With these and other objects in view which will more readily appear as the nature of the invention is better understood, the invention consists in the novel construction, combination and arrangement of parts hereinafter more fully illustrated, described and claimed, with reference being made to the accompanying drawings.

Similar reference characters designate corresponding parts throughout the several figures of the drawings.

DESCRIPTION OF THE PREFERRED EMBODIMENT

Figure 1:
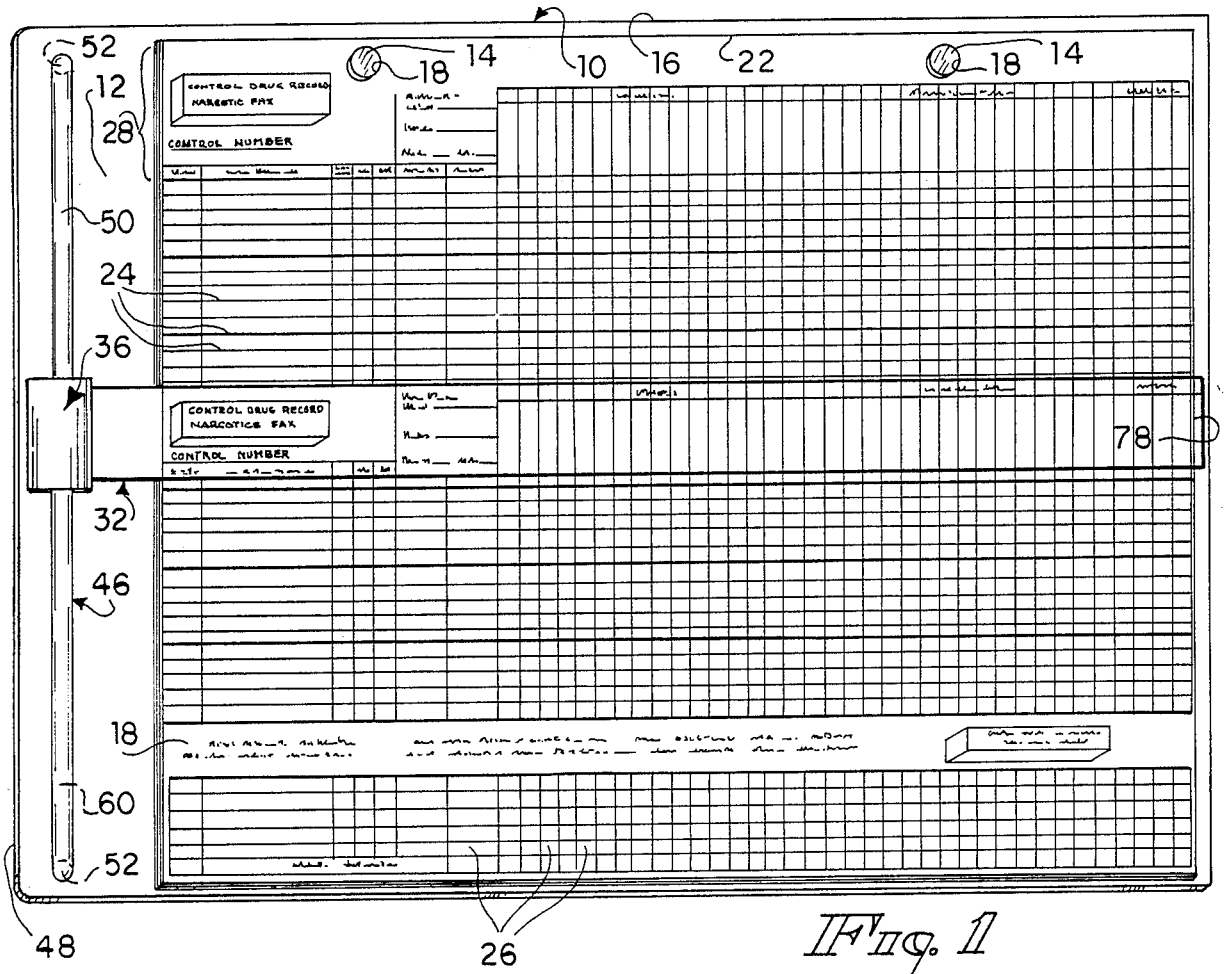
FIG. 1 is a top plan view of the rectangular control board according to the present invention.

Referring now to the drawings, particularly FIG. 1, the present invention will be seen to comprise a control board, generally designated 10, and which is preferably rectangular in configuration and constructed of self-sustaining, rigid material, such as plastics or lightweight metal. The board 10 is provided with a planar upper surface 12 and includes at least a pair of registry members, such as pins or pegs 14,14 adjacent the board top edge 16. These pegs 14 provide locating and retention means for one or more stacked chart sheets 18 having holes 20 adjacent the upper edge 22 of the sheets.

Each chart 18 will be understood to serve as an updateable means to maintain a current inventory or record of various items, materials or instances. A typical instance would involve maintaining a record of medications administered to a plurality of patients on say, each ward of a hospital. Thus, each chart sheet 18 may be provided with a plurality of horizontally disposed rows 24 and intersecting vertical columns 26, all extending substantially the majority of the width and height of the sheets, respectfully. With this construction, any of various inventories may be maintained by utilizing the rows 24 within certain columns 26 to record specific aspects of the desired inventory. For example, one column 26 may contain the names of all patients in one ward while other columns specify the medication, dose, physician and time administered for each dose. The primary concern in using any such chart sheets is to insure the proper vertical alignment of entered data, beneath the proper column heading as reflected at the top of each sheet 18. The specific construction offered by the present chart sheets and the control board 10 insures the most accurate recording of information by the user.

Figure 3:
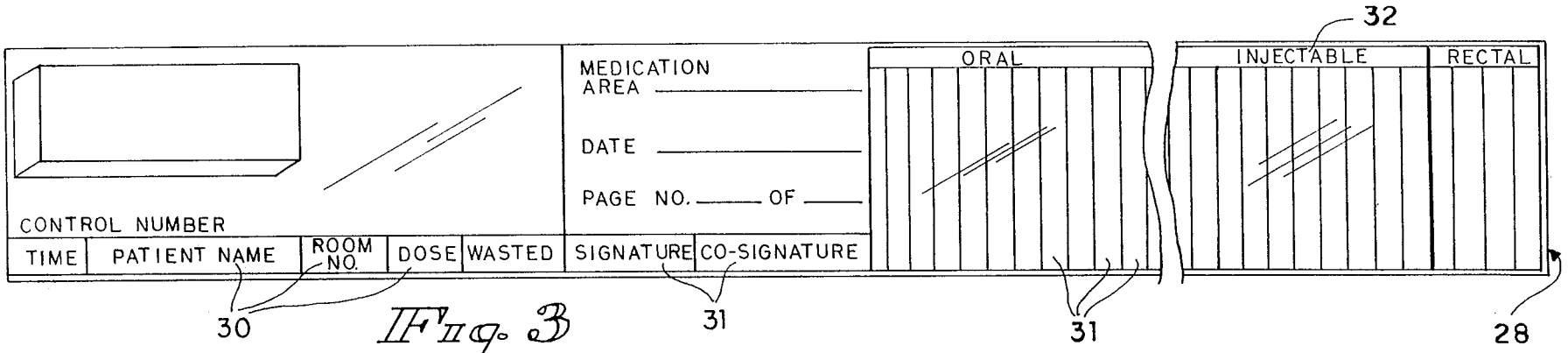
FIG. 3 is an enlarged top plan view of the data columns as provided on both the top of the chart sheets and on the ruler member.

Each sheet 18 includes a heading band 28 extending the width of the sheet and located immediately adjacent the top edge 16 thereof. FIG. 3 of the drawings most clearly illustrates this heading band 28, wherein it will be seen that the band includes indicia 30 arranged across the width of the band with each defining one of a plurality of individual control items or parameters and each set apart as a separate adjacent column 31. The critical nature of each column's indicia 30 will be apparent from a review of FIG. 3 as it will be obvious that data entered on the rows 24 beneath the heading band 28 must be precisely located to maintain integrity in the resultant inventory or record.

Achieving the above mentioned integrity when entering data in the rows 24 immediately below the heading band 28 will quite obviously be easily obtained in view of the proximity of the heading band columns 31 to those columns 26 beneath the heading band. On the other hand, when the user needs to enter data along a row 24 say, half-way down the chart sheet 18, difficulty is encountered in assuring proper vertical alignment between the distant heading band columns 31 and the columns 26 across the subject row 24.

To facilitate accurate data reading and entry through out the entire vertical height of the chart sheets 18, a vertically shiftable ruler member 32 is attached to the control board 10. The ruler includes an elongated, flat blade 34 of a length greater than the width of the sheets 18 and which is attached to a slide block 36, as shown most clearly in FIGS. 2 and 4. The block will be seen to include a top 38 and an opposite bottom 40 and serves to secure the inner end 42 of the ruler blade 34 which engages the block bottom and is suitably affixed to the block outside face 44, such as by removable fasteners (not shown).

The ruler 32 is captively mounted relative the board 10 by support means comprising a slide rod 46 attached adjacent the left hand lateral edge 48 of the board as shown in FIG. 1. This rod preferably comprises a round member including a horizontally disposed straight, main section 50 terminating in distal, vertically extending legs 52,52. The legs, suitably anchored to the board 10, are of a length sufficient to insure that the main section 50 is disposed a substantial distance above the plane of the board upper surface 12, for reasons which will become apparent hereinafter.

Figure 2:
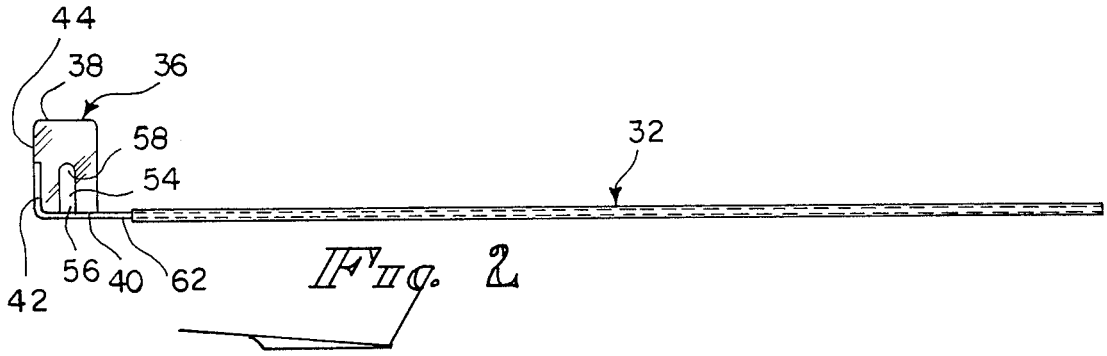
FIG. 2 is a front elevation of the ruler member illustrating the slide block as captively retained by the slide rod mounted on the board.
Figure 4:
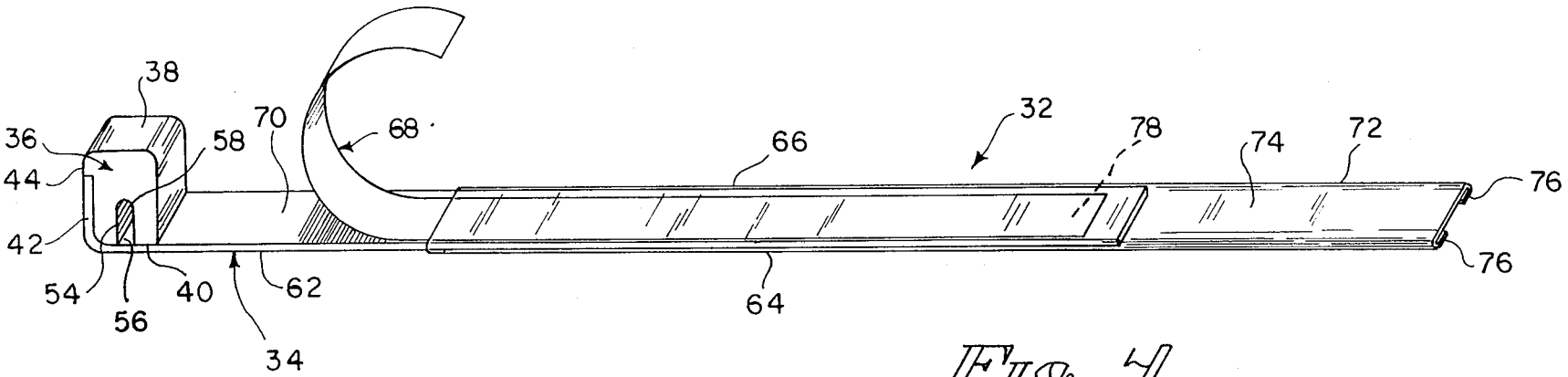
FIG. 4 is a perspective view illustrating the ruler member and the retention means serving to permit removable attachment of the columnar strip.

The ruler member 32 is attached relative the board, by means of the disposition of the slide rod main section 50 within the confines of a vertically elongated slot or opening 54 provided through the body of the block 36. As shown in FIGS. 2 and 4, the slot 54 includes a bottom end 56 opening through the block bottom 40 while the top end 58 of the slot 54 stops short of the block top 38. With this construction, the ruler member 32 is easily assembled and removed from the board slide rod 46 by disconnecting the inner end 42 of the blade 34 from the block, thus exposing the open, bottom end 56 of the slot and allowing ready movement of the rod into or out of the slot. By installing the slide rod so as to provide a substantial space 60 therebeneath, it will follow that many chart sheets 18 may be carried upon the board and as sheets are added or removed, the lower surface 62 of the blade 34 of the ruler member 32 will at all times remain flushly juxtaposed, throughout its entire length, the upper face of the topmost sheet 18.

Quite obviously, as the ruler member 32 is vertically displaced over the chart sheet 18, its straight lower edge 64, as well as its straight upper edge 66, will provide positive identification of each horizontal row 24 but the most important feature of the present invention is the precise identification of all the vertical columns 26, regardless of the vertical positioning of the ruler member 32. This is accomplished in view of a columnar heading strip 68 mounted atop the upper surface 70 of the ruler member blade 24. This strip 68 preferably comprises a duplicate of the heading band 28 as printed at the top of the chart sheets 18, that is, it includes blank or indicia-containing columns 31 laterally spaced identical to the same areas of the heading band 28. With this arrangement, a user of the control board need not rely upon the accuracy of their eye to insure vertically aligning any column 31 from the sheet heading band 28 when either reading or entering data in a row 24 disposed well below the top of the sheet.

To allow use of the board with any of various chart sheets, having alternate column widths and/or indicia, the ruler member strip 68 is readily replaceable as shown in FIG. 4. Although reusable pressure sensitive strips may be used, it is proposed that the strip 68 be secured in its use position by means of a retainer element 72 comprising a transparent member having a top face 74 joined to two flanges 76,76 and which is adapted to slidably envelope the blade 34, with the heading strip 68 therebetween.

Replacement of chart sheets 18 is conveniently accomplished by raising the free end 78 of the ruler member 32, thus pivoting the slide block 36 about the slide rod 46 until the blade 34 is vertically disposed. The ruler member will retain this vertical position on its own, as it is supported by engagement of the outside face 44 upon the upper surface 12 of the board.

I claim:

1. A data inventory control apparatus comprising;

a substantially rectangular board having a chart sheet thereon and provided with an upper edge, indicia defining rows and columns on said sheet, a heading band on said chart sheet adjacent said upper edge, said heading band having indicia defining distinctive columns vertically aligned with said sheet columns, a ruler member transversely overlying said chart sheet on said board, mounting means attaching said ruler member to said board and allowing vertical shifting of said ruler member substantially over the vertical extend of said chart sheet, said mounting means including a slide rod attached to said board adjacent said chart sheet, said ruler member including a slide block having an opening therethrough and a flat face normal to said ruler member and facing the edge of said board proximal to said slide block and slide rod, said slide rod disposed within said block opening, said slide block adapted to pivot about said slide rod, said ruler member tiltable vertically above said board to a position with said slide block flat face flushly abutting said board, a heading strip atop said ruler member and having indicia thereon defining columns similar to said columns on said sheet heading band whereby, said ruler member may be vertically shifted within a substantially common plane to a selected one of said chart sheet rows to position said heading strip columns immediately adjacent said selected chart sheet rows to allow reading or entering of data in precise columns on said chart sheet according to identical columns as presented by said ruler member heading strip.

2. A data inventory control apparatus according to claim 1 wherein;

said ruler member includes a blade having one end connected to said mounting means, and means removably attaching said heading strip to said blade.

3. A data inventory control apparatus according to claim 1 including;

registry means on said board cooperating with said sheet to retain said sheet atop said board and preclude vertical or horizontal shifting of said sheet relative said board.

4. A data inventory control apparatus according to claim 1 wherein;

said heading band and heading strip columns are of varying widths.

5. A data inventory control apparatus according to claim 2 wherein;

said attaching means includes a retainer element slideably encircling said blade.

6. A data inventory control apparatus according to claim 1 wherein, said slide block opening is vertically elongated whereby, various numbers of said chart sheets may be placed upon said board with said ruler member automatically vertically displaceable to flushly engage the topmost one of said sheets as said slide block opening freely moves vertically according to the number of said sheets upon said board.

7. A data inventory control apparatus according to claim 3 wherein, said registry means includes a plurality of upstanding pins on said board and said sheet includes a plurality of mating holes therein spaced to engage said pins.

8. A data inventory control apparatus according to claim 5 wherein, said retainer element includes a top face of transparent material.

9. A data inventory control apparatus according to claim 1 wherein, said ruler member includes an elongated blade, and said blade and slide block is angularly displaceable 90 degrees about said slide rod with said ruler member thereafter supportable upon said board, whereby one or more said chart sheets may be placed upon or removed from atop said board without interference from said ruler member.

* * * * *